United States Patent [19]

Cassiers et al.

[11] 4,139,653

[45] Feb. 13, 1979

[54] METHOD FOR THE DEVELOPMENT OF ELECTROSTATIC CHARGE PATTERNS

[75] Inventors: Paul M. Cassiers, Mortsel; Willy G. Verlinden, Edegem, both of Belgium

[73] Assignee: AGFA-GEVAERT N.V., Mortsel, Belgium

[21] Appl. No.: 732,426

[22] Filed: Oct. 14, 1976

Related U.S. Application Data

[63] Continuation of Ser. No. 432,037, Jan. 9, 1974, abandoned.

[30] Foreign Application Priority Data

Jan. 10, 1973 [GB] United Kingdom ..... 1411/73
Jan. 10, 1973 [GB] United Kingdom ..... 1412/73

[51] Int. Cl.[2] ..... G03G 13/10

[52] U.S. Cl. ..... 427/16; 96/1 LY; 118/109; 118/119; 118/661; 355/10; 427/359

[58] Field of Search ..... 427/15, 16, 17, 359; 96/1 LY; 118/661, 102, 109, 110, 204, 119, 118; 355/10

[56] References Cited

U.S. PATENT DOCUMENTS

| | | | |
|---|---|---|---|
| 2,531,036 | 11/1950 | Goettsch | 101/167 |
| 2,889,758 | 6/1959 | Bolton | 355/3 |
| 3,084,043 | 4/1963 | Gundlach | 427/15 |
| 3,262,840 | 7/1966 | Hervey | 101/425 |
| 3,356,066 | 12/1967 | Larsson et al. | 118/109 |
| 3,368,526 | 2/1968 | Matsumoto et al. | 427/17 |
| 3,383,209 | 5/1968 | Cassiers et al. | 427/15 |
| 3,389,656 | 6/1968 | Giori | 101/167 |
| 3,468,248 | 9/1969 | Giori | 101/167 |
| 3,815,989 | 6/1974 | Davis et al. | 355/15 |
| 3,820,891 | 6/1974 | Kurakawa et al. | 427/17 |
| 3,830,199 | 8/1974 | Saito | 118/661 |
| 3,839,071 | 10/1974 | Borelli | 118/661 |
| 3,923,002 | 12/1975 | Vanyi | 118/110 |

FOREIGN PATENT DOCUMENTS 1252910 11/1971. United Kingdom.

*Primary Examiner*—Ronald H. Smith
*Assistant Examiner*—Stuart D. Frenkel
*Attorney, Agent, or Firm*—William J. Daniel

[57] ABSTRACT

A process of producing a liquid image, wherein an insulating material bearing an electrostatic charge pattern detectable at its surface is developed by wetting with a developing liquid according to such charge pattern and wherein in said process developing liquid is brought substantially uniformly in close proximity to or in contact with said material by the use of at least one developing liquid applicator means followed by at least one other means that is capable of removing from the charge-carrying member some of the developing liquid already deposited by the or a said preceding applicator means.

5 Claims, 1 Drawing Figure

METHOD FOR THE DEVELOPMENT OF ELECTROSTATIC CHARGE PATTERNS

Figure 1:
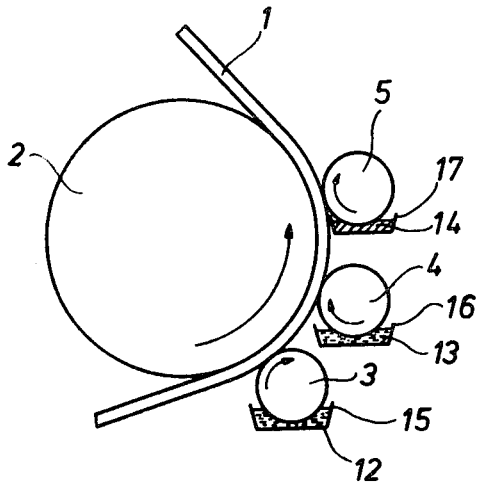

This is a continuation of Ser. No. 432,037, filed Jan. 9, 1974, now abandoned.

This invention relates to a method and apparatus for the development of electrostatic charge patterns.

From the United Kingdom Patent Specification No. 1,020,505 a process for developing electrostatic charge patterns is known according to which liquid is deposited on a hydrophobic surface of an electrostatic charge carrier bearing an electrostatic charge pattern detectable at such surface, by establishing contact or close proximity between such surface and a liquid supply means comprising at least one capillary recess or passage in which a quantity of an aqueous liquid medium (which may be water alone) by which such surface is normally substantially unwettable is held so that under the influence of the electrostatic charges borne by said carrier liquid medium is attracted from the capillary recess(es) or passage(s) and deposits on and wets said surface in accordance with the said charge pattern.

In the United Kingdom Patent Specification No. 987,766 a "wetting development" process has been described according to which aqueous developers are used whose wetting angle (contact angle) is greater than 90° at the uncharged areas of the electrostatic charge carrier and smaller than 90° at the charged areas to be wetted.

From the United Kingdom Patent Specification No. 1,020,503 it is further known to use an electric field in superposition to the charge carrier during development. According to a particular embodiment a direct current voltage is applied between the developing liquid and the charge carrier to be developed. The use of a field direction opposite to that of the charged carrier increases the image-contrast, whereas an electrostatic field of a same direction as that of the charged carrier reverses the image.

In the prior art wetting development processes the developing liquid is either brought into contact with or in close proximity to (within the distance of electrostatic attraction) the electrostatic charge carrier.

According to a particular wetting development process the developing liquid is supplied to the electrostatic charge carrier with only one applicator roller whose applicator surface is covered with such an amount of liquid that a liquid bead (liquid meniscus) is formed between the applicator surface of the roller and the charge carrier. According to that process the developing liquid is brought into contact with the charged as well as with the uncharged areas of the charge carrier. The applicator surface of the applicator roller is smooth or provided with capillary recesses e.g. grooves. In the latter case the capillary recesses are filled up with an excess of developing liquid so that the tops or crests of said recesses are covered thereby.

According to another wetting development process the developing liquid is supplied with only one applicator roller having in its applicator surface capillary recesses, e.g. grooves in which the developing liquid is sucked up by capillarity and whose tops or crests are free or freed from developing liquid, which is supplied within the attraction distance of the electrostatic charge pattern of the charge carrier and image-wise deposited thereon.

Since the wetting development technique operating with uninflammable, odourless liquids has definite advantages over other known liquid developing techniques such as electrophoretic development, great interest exists in optimizing the developing results obtainable with said technique. It has been established experimentally that although quite satisfactory results have been obtained already, e.g. by operating along the lines described in the above mentioned prior art, still further improvements are required with respect to the uniformity of applying the developing liquid and the rendering of fine image details. In the developing process operating with only one applicator roller, e.g. a "smooth-surface" roller or "capillary-surface" roller, the charge carrier material is supplied with an amount of developing liquid that is normally in excess for charged area of large size whereas the small charged area e.g. thin lines, receive too little developing liquid so that image detail rendering has still to be improved.

There has now been found an improved process for the production of a liquid image by wetting development of a material carrying an electrostatic charge pattern with a developing liquid supply means in which the improvement resides in bringing developing liquid, substantially uniformly in close proximity to and/or in contact with said material by the use of at least one developing liquid applicator means followed by at least one other means that is capable of removing from the charge-carrying material some of the developing liquid already deposited by the or a said preceding applicator means.

According to a preferred embodiment a series of successive applicator rollers is used in which the last roller or a number of the last rollers in the series have a surface provided with capillary recesses or passages that are capable of sucking up developing liquid deposited by the preceding applicator roller(s) (smooth surface and/or capillary surface roller(s)) or other preceding applicator means, e.g. a spraying coater, a brush coater, a whirl coater, as described e.g. in French Patent Specification 2,083,919, a web supplying developing liquid or a trough containing developing liquid in which the charge carrier contacts the developing liquid in a manner known for coating techniques such as dip-coating or meniscus-coating.

The present developing process may be combined with the developing process described in commonly owned U.S. Pat. application, Ser. No. 432,036, filed Jan. 9, 1974. Said application relates to a process of producing a liquid image, wherein an insulating material bearing an electrostatic charge pattern detectable at its surface is developed with a developing liquid thereby to record such pattern or a liquid pattern, and in which process developing liquid is brought substantially uniformly in close proximity to and/or in contact with said material with at least two developing liquid applicator means, which are disposed in succession along the path followed by said material and which supply developing liquid to said material in such a way that the liquid image is gradually built up by amounts of liquid offered by such successive applicator means.

Said process includes the step supplying developing liquid to said material with at least two successive roller applicators with capillary liquid-holding openings or recesses that are arranged so that zones of said material, which do not come directly opposite a quantum or quanta of liquid held by one roller, come directly opposite a quantum or quanta of liquid held by a succeeding roller.

According to a preferred embodiment of said process the supply of developing liquid to the charge-carrying material proceeds with a plurality of, preferably two or three, rotatable grooved applicator rollers the grooves of the various rollers of which are not in alignment. Operating that way the probability that a particular area of the recording material does not come in contact with or does not come in close proximity to the developing liquid becomes very small so that development proceeds more uniformly and without or substantially without leaving traces of the grooves.

According to a particular embodiment of the present invention, a series of successive applicator rollers is used of which the last applicator roller or a number of applicator rollers at the end of the series has or have an applicator surface provided with capillary passages or recesses, e.g. grooves that are empty, thus leaving free space to suck up developing liquid that has been deposited in too high an amount.

Although for operating along the lines of the above embodiment preference is given to applicator rollers having a capillary groove or grooves, the surface of the first applicator roller up to the last but one applicator roller may be smooth or obtain capillarity by any method known in the art and the form of the capillaries may be of any type. The rollers may be made of metal e.g. iron, bronze, copper, silver and aluminium, and plastic materials whose surfaces may be treated or coated with another material to confer appropriate wetting properties, i.e. adhesion for the developing liquid.

Applicator rollers having capillary recesses openings or channels may be obtained, e.g., by turning, milling, engraving or etching.

The geometric form of capillaries is not critical. For example the capillaries may be conical, rectangular, cylindrical, semi-spherical or irregular.

According to a special embodiment each applicator roller contains capillary grooves that are substantially perpendicular to the axis of revolution of the roller. Each applicator roller may contain one or more similar or different helical groove(s) or non-interconnecting grooves associated in parallel relationship. Said non-interconnecting grooves may be enclined to the axis of revolution of the roller.

The applicator rollers need not be identical neither in size nor in their structure, including their composing material(s). Thus, e.g., the surface structure of different rollers and/or their diameter and/or the material(s) from which they are made of may be different. For example, when grooved rollers are used the grooves may be of different width and/or depth and when applicator rollers with a helical groove are used the grooves may be of varying pitch. The depth and the width of the grooves is preferably in the range of 0.01 to 1 mm.

In a particular embodiment at least one of the liquid applicator rollers has a screened surface. Such screen may be a line screen or screen consisting of small capillary holes and if there are two or more such rollers the holes may be of the same or variable depth and area on the different applicator rollers.

Capillarity acts as a kind of restraining force against which electrostatic charge attraction (coulomb force) has to operate when the developing liquid is brought in contact with or in close proximity (within the attraction distance) of the electrostatic charge pattern of the recording material. The imposition of such a restraint leads to better image definition and such restraint according to a particular embodiment is different for both or for a number of or for all of the applicator rollers. Such makes it possible to have the strongest restraining force at the first roller so that with that roller only the most strongly charged areas are developed and with another roller or rollers exerting a less high restraining force, development of the less strongly charged area can take place.

It is also possible to have the strongest retaining forces at the last roller(s) so that in the case of solid area, excess liquid which is deposited by the first roller(s) can be removed by the subsequent roller(s). The gradual increase or decrease in the capillary forces on the subsequent roller(s) can be established by well-known means, e.g. by a change in specific area of the capillaries or in the material used for the capillaries.

According to a preferred embodiment the crests or tops of the capillary passages or recesses, e.g. grooves, before contact with the material to be developed, are freed from developing liquid with a doctor knife or other cleaning means, e.g. squeegee rollers, so that images with a particularly clean image background are obtained. The tops or crests of the capillary passages or recesses, e.g. grooves, of the applicator rollers may likewise be kept free from developing liquid by using capillaries whose deep parts consist of hydrophilic material, e.g. chromium, and the high parts or tops consist of hydrophobic material, e.g. copper (see for such technique the United Kingdom Patent Specification No. 1,020,505). Both embodiments of non-wettable tops and cleaning means may be combined.

Preferred embodiments with respect to the arrangement of the applicator rollers in an apparatus in which wetting development of electrostatic charge patterns can be carried out according to the present invention are illustrated in the accompanying schematic drawing.

FIG. 1 is a cross-sectional representation of a developing station of the present invention.

It should be understood that in said figure the right relative dimensions are not represented in order to bring out the details of the construction.

In FIG. 1 the member 1, which carries the electrostatic charge pattern, is fed between the pressure roller 2 and the applicator rollers 3, 4 and 5 respectively. The roller 3, which has a smooth wettable surface, revolves in the developing liquid 12 present in the trough 15 and forms a liquid meniscus (not shown) with the member 1. The roller 4, which has a surface with parallel non-interconnecting grooves revolves in the developing liquid 13 contained in the trough 16 whereas the helically grooved roller 5 revolves in contact with a liquid-absorbing means, e.g. a sponge-like pad 14 in trough 17. The angular speed and the diameter of the rollers 3, 4 and 5 are the same. Roller 5 has a capillary groove, which does not contain or is only partly filled with developing liquid and takes up any developing liquid which may have been deposited in excess by the rollers 3 and 4.

When in the developing stations of the present invention grooved developing rollers are used they have preferably a rather small diameter, e.g. in the range of about 5 to about 25 mm.

As already explained in connection with the United Kingdom Patent Specification No. 1,020,503 it is possible to control the wetting development by applying a superimposed additional electric field between the developing liquid and the member carrying the charge pattern. The use of an additional field with a direction opposite to that of the charge pattern increases the image contrast, whereas an additional field with a direction being the same as that of the charge pattern may result in image reversal. In the latter case the internal electric polarization of the dielectric charge-carrying member under the influence of the additional electric field is probably responsible for the wetting of the recording member portions that do not contain a surplus charge image (externally applied charge).

The developing process and apparatus of the present invention may be applied in the wetting development of any kind of member carrying an electrostatic charge pattern.

The expression "electrostatic charge pattern" is used broadly to include any distribution of charges within a support area such that different parts of this area are charged to different extents or such that some parts only are charged. Thus, the expression includes, e.g., electrostatic images of reading matter, diagrams, pictures, etc., and charges constituting the electrostatic record of wireless or other electric signals.

The particular method by which the electrostatic charge pattern is formed is not in any way crucial. By way of example the charge pattern may be obtained by electrographic or electrophotographic processes.

In electrographic recording techniques electrostatic charges are produced on dielectric surfaces in a variety of patterns or configurations with either electric discharge or electric current or image-wise or signal-wise deposition of charged particles, e.g. electrons and/or ions. For example, an insulated pencil with a metallic point can be used to write or draw invisible electrostatic images on a dielectric film if sufficient voltage is applied to the metallic point.

A survey of electrographic processes known as electrostatic printing and facsimile reproduction has been given by R. M. Schaffert, in the book "Electrophotography", The Focal Press, London and New York (1965), 111–123 and in the book "Xerography and Related Processes" edited by John H. Dessauer and Harold E. Clark — The Focal Press — London and New York (1965) 439–460.

The recording material used in electrography is, e.g., a web consisting of an insulating coating of plastic on a paper base having sufficient conductivity to allow electric charge to flow from a backing electrode to the paper-plastic interface.

A review of the production of electrostatic charge images by electrophotography has been given by Robert B. Comizzoli, Gerald S. Lozier and Donald A. Ross in the Proceedings of the IEEE, Vol. 60, No. 4, April 1972, pages 348–369. From that review can be learned that in electrophotography the recording element contains or consists of a photoconductive member or is a photo-emissive member. Onto or into such member or onto a charge receiving or collecting insulating member associated therewith an electrostatic charge pattern is formed.

The most commonly used form of electrophotography is based on the development of a latent electrostatic image on an overall precharged and image-wise exposed insulating photoconductive layer. The photoconductive layer may be coated on a drum (e.g. selenium drum) from which the developing substance deposited in the charged areas is transferred to a receiving member, e.g. sheet of paper.

In order to avoid the need to transfer the developer substance to a receiving member the photoconductive layer may be directly coated on a sheet or weblike material, e.g. paper, on which the developed and fixed print is formed. In the latter process the photoconductive layer contains commonly white photoconductive zinc oxide particles dispersed in an insulating binder layer on paper serving as support.

For developing the electrostatic charge pattern a liquid medium is used, which does not normally wet the surface of the charge carrying member, or not to any appreciable extent, but which will wet such surface under the influence of the encountered electrostatic attractive charges so as to record the electrostatic charge pattern in terms of surface wetting. In the interest of forming good quality records it is preferable that the electrostatic charges are capable of reducing the contact angle between the liquid and the charged surface to such an extent that complete surface wetting occurs (contact angle of 0° or approximately so).

The members carrying a charge pattern have in non-charged state preferably such surface properties that the developing liquid forms a contact angle preferably larger than 100° C. For a definition of "contact angle" see I. Alexander, Colloid Chemistry, Vol. I, Principles and Applications, 4th Ed., D. van Nostrand Company, Inc., New York, p. 78–80.

Preference is given to aqueous developing liquids. When such liquids are used, the members carrying a charge pattern have to be hydrophobic in their non-charged state (contact angle preferably larger than 100° C.).

The developing liquid is preferably highly polarizable so that liquids with dielectric constant of at least 30 are particularly preferred. Water, as is generally known has a dielectric constant of 80. Useful organic liquids with "high" dielectric constant are, e.g., methanol, ethanol, glycerol, formamide and dimethylformamide. The developing liquid may be electrically conductive, e.g., has a resistivity lower than $10^6$ ohm.cm.

Water alone or water containing at least one other ingredient (e.g. organic polar liquid) may be used as developing liquid provided that the composition as a whole has the requisite properties referred to. In general it is preferred to use in the developing liquid at least 60% by weight of water. The developing liquid may be a solution or a dispersion (suspension or emulsion). Conductive developing liquids normally contain free ions e.g. of dissolved salts.

A survey of suitable developing liquids for wetting development is given in the United Kingdom Patent Specifications Nos. 987,766, 1,020,503, 1,020,505, 1,032,264, 1,068,472 and 1,068,473.

According to a preferred feature in the developing process of the present invention a photoconductive layer with hydrophobic properties is used as carrier for the electrostatic charge pattern. Preferably the photoconductive layer comprises a photoconductor dispersed in an insulating binding agent. The usual photoconductive layers, which comprise organic or mineral photoconductive substances dispersed in an insulating polymeric binding agent, and the photoconductive layers, which comprise organic photoconductive polymers, possess a hydrophobic character.

Electrophotographic recording layers that are particularly suitable for wetting development with aqueous developing liquids are described in the United Kingdom Patent Specification Nos. 987,766, 1,020,503 and 1,020,505.

The wettability of a surface may be influenced by the surface roughness as described in the U.S. Pat. Specifications Nos. 3,472,676 and 3,486,922. Thus, the degree of roughness or content of micro-recesses in the surface of a charge carrier, e.g. a photoconductive layer, may be influenced by suitably choosing the grain size and the degree of dispersion of the photoconductive material or by the controlled flocculation of the binding agent in some solvents.

Surface roughness can also be obtained by applying the insulating layer e.g. photoconductive layer, in a regular or irregular screen form.

We claim:

1. A process of producing a liquid image, comprising the steps of:

bringing uniformly into at least close proximity with the surface of an insulating material carrying a detectable electrostatic charge pattern a developing liquid which is non-wettable with respect to said material surfaces in its uncharged state and selectively attracted into wetting contact with said surface in its charged state, whereby developing liquid is selectively applied to said charged surface area to develop said charge pattern, and contacting the entirety of said insulating material surface while carrying the thus-applied liquid image thereon with a rotatable metal roller carrying on its periphery a pattern of capillary grooves substantially perpendicular to the roller axis and separated by lands or crests, said grooves absorbing therein by capillary forces liquid brought into contact therewith, said grooves being substantially empty of liquid when contacted with said material surface and absorbing excess developing liquid from said developed charge pattern into the empty space of said grooves by capillary forces.

2. The method of claim 1 including the steps of bringing the periphery of said grooved roller at a point on its path after contact with said developed material surface into contact with liquid absorbing means to remove from said grooves developing liquid absorbed from said developed charge pattern.

3. The process according to claim 1 wherein said developing liquid is a conductive polarizable liquid.

4. The process according to claim 1 wherein said insulating material surface is hydrophobic and said developing liquid is aqueous.

5. The process according to claim 1 wherein the crests or lands of said capillary recesses before contact with the insulating material to be developed are wiped free from developing liquid.

* * * * *